US005524302A

United States Patent [19]

Ragsdale et al.

[11] Patent Number: 5,524,302

[45] Date of Patent: Jun. 11, 1996

[54] METHOD AND APPARATUS OF EXTENDING AND RETRACTING SWIMMING POOL COVERS

[75] Inventors: Kelly J. Ragsdale, Salt Lake City; Cory Brady, West Jordan, both of Utah

[73] Assignee: Cover-Pools, Inc., Salt Lake City, Utah

[21] Appl. No.: 841,615

[22] Filed: Feb. 25, 1992

Related U.S. Application Data

[63] Continuation-in-part of Ser. No. 393,407, Aug. 11, 1989, Pat. No. 5,105,481, which is a continuation of Ser. No. 825,988, Feb. 4, 1986, Pat. No. 4,858,253, which is a continuation of Ser. No. 642,347, Aug. 20, 1984, abandoned.

[51] Int. Cl.[6] ..... E04H 4/10

[52] U.S. Cl. ..... 4/502; 242/388.8; 242/390.9; 242/919

[58] Field of Search ..... 4/502, 501, 500, 4/498, 503; 242/919, 388.8, 421.2, 390.8

[56] References Cited

U.S. PATENT DOCUMENTS

| | | | |
|---|---|---|---|
| 3,050,743 | 8/1962 | Lamb | 4/502 |
| 4,060,860 | 12/1977 | Lamb | 4/502 |
| 4,324,370 | 4/1982 | Guard et al. | 4/502 |
| 5,184,356 | 2/1993 | Lof et al. | 4/502 |

FOREIGN PATENT DOCUMENTS

| | | | |
|---|---|---|---|
| 3102362 | 11/1982 | Germany | 4/502 |

*Primary Examiner*—Linda J. Sholl
*Attorney, Agent, or Firm*—Trask, Britt & Rossa

[57] ABSTRACT

An apparatus for extending and retracting a swimming pool cover includes a motor, a drive shaft connected to the motor, a cover collecting drum attached to the drive shaft and a cable collecting reel mounted on the drive shaft. A series of gears are configured to selectively engage the drive shaft with either the cable collecting reel or the cover collecting drum. A cable secured at one of its ends to the cable collecting reel and at its opposing end to the leading edge of a cover mounted on the cover collecting drum is operative to extend the cover over a swimming pool. The cover collecting drum functions to retract the cover from off of the swimming pool.

21 Claims, 17 Drawing Sheets

METHOD AND APPARATUS OF EXTENDING AND RETRACTING SWIMMING POOL COVERS

RELATED APPLICATIONS

This application is a continuation-in-part of application Ser. No. 393,407 filed 11 Aug. 1989, now U.S. Pat. No. 5,105,481, which is a continuation of application Ser. No. 825,988 filed 4 Feb. 1986, issued 22 Aug. 1989 as U.S. Pat. No. 4,858,253, which is a continuation of application Ser. No. 642,347 filed 20 Aug. 1984, now abandoned.

BACKGROUND OF THE INVENTION

1. Field

This invention relates to apparatus adapted for extending and retracting a fabric cover over a contained body of water, such as a swimming pool.

2. Statement of the Art

Swimming pools of both the residential and commercial variety are becoming commonplace in contemporary society. With increasing demands being place on supplies of natural resources such as water and energy, serious attention is now being directed to more conservationist approaches in managing swimming pools. Observably, swimming pools can be a source of considerable water loss due to evaporation. Secondly, the cost of the energy required to maintain the temperature of the water in the pool at a level comfortable for swimming is a strong incentive to adopt measures which promote retention of heat in the pool and retain heat loss.

As a tertiary consideration, it should be remembered that conventional swimming pool maintenance requires the frequent treatment of the water in the pool with antibacterial preparations such as chlorine. Loss of these preparations due to evaporation can create a sizable financial burden to the pool owner.

Within the last forty years, innovative attempts have been made to develop covers which could be placed over the swimming pool during times of nonuse. These covers address many of the problems raised above. The covers tend to retard evaporation of the water and antibacterial preparations from the pool. Secondly the covers retain heat within the pool water. Some cover manufacturers have even advocated that their covers act as solar collectors in that the sun's rays are permitted to continue heating the water with the cover in place. The cover then retains the heat within the water, thereby leading to an increased overall heat gain.

Conventional swimming pool covers typically include a pair of rigid guide tracks which are installed along parallel opposite sides of the pool. A cover collecting drum is disposed adjacent one end of the pool. A fabric cover often manufactured of a heavy weight vinyl is wrapped about the drum. The sides of the fabric cover are generally formed to have a beaded edge which is configured to be received into a respective guide track for back and forth guided displacement along the guide track. Conventionally, each beaded edge is formed by the cover being hemmed along its side edge. A respective rope is passed through each hem to form a bead. The rope exits the hem at the end of the cover. The rope is directed into a separate channel in the guide track which leads the rope back to a rope-collection reel positioned proximate the cover collecting drum. The cover is displaced along the guide track by a drive assembly which includes a motor, a drive shaft connected to the motor, and a plurality of rope collecting reels.

A plurality of reels is mounted on the drive shaft and is thereby operably associated with the motor. The drive shaft is also connected to the cover collecting drum.

Operationally, the motor, in one condition, is adapted to collect the ropes on their respective reels by rotating the reels. In this condition the cover collecting drum is traditionally rendered free wheeling about the drive shaft. As the ropes are collected on the reels, the cover is forcedly extended across the pool as the ropes are displaced through their respective guide tracks on their way to be collected on their respective reels. To retract the cover, the motor is shifted to a second condition wherein the cover collecting drum is directly engaged with the motor. Correspondingly, the reels are now left in a free wheeling condition about the drive shaft. As the cover collecting drum is turned, the cover is forcedly wrapped about the drum thereby retracting the cover from off of the pool.

While residential pools have been well served by conventional pool cover systems, serious complications have been encountered when attempts have been made to apply conventional pool cover systems to large commercial swimming pools. Oftentimes, commercial pools are so wide dimensionally that the weight of a vinyl cover, which would be required to span the pool exceeds any practical weight carrying limitations of a guide track which could be used to guide it. In recognition of this problem, current attempts to cover commercial pools have been directed to the use of multiple panels of a fabric formed of a polyethylene substrate adhered to a foam buoyant layer. The fabric is formed into elongate panels which are manually pulled over the surface of the water in the pool. The panels are then floated into engagement one with another to form a floating cover system.

While conventional systems require the user to manually pull the cover over the pool, some efforts have been made to devise a manually operated roller adapted to retract the cover from the pool once it has been installed. Another system utilizes a driven cover collecting drum which is mounted to an upstanding wall adjacent the end of the pool. The drum is fitted with a plurality of straps mounted spacedly along the length of the drum. The straps are each secured to the cover at spaced locations along the cover end. The cover is installed over the pool by the user manually pulling the cover off of the cover collecting driver and manually positioning the cover over the pool. When it is desired to retract the cover from the pool, the drum is rotated by a motor. The rotation of the drum causes the cover to be collected on the drum thereby retracting it from off of the pool.

While these systems somewhat address the problem of powered retraction of the cover from a commercial pool, these systems do not provide a mechanism for powered extension of the cover over the pool. There continues to be a need for an apparatus adapted to both extend and retract a cover over a commercial or large residential swimming pool.

SUMMARY OF THE INVENTION

An apparatus of the instant invention includes a motor having a drive shaft associated therewith. At least one cable collecting reel is mounted on the drive shaft to be free wheeling thereon. A cover collecting drum is also mounted on the drive shaft to be free wheeling thereon. An intercooperation means is adapted to the drive shaft to permit the driving engagement of the drive shaft with the cable collecting reel in one condition and the driving engagement of the drive shaft with the cover collecting drum in a second condition. These components together constitute a drive assembly.

A cover is secured at its first end to the cover collecting drum. The cover is preferably manufactured of a material which is buoyant when placed in water. In preferred constructions, the drive assembly is positioned elevationally above a first end of the pool at a location which minimizes the opportunity of its being contacted by a pool user. Due to this positioning of drive assembly, and recognizing the considerable weight of the fabric to be positioned over the pool, it is crucial that the buoyant forces created by the interaction of the cover and the water be brought into application on the cover as soon as possible during the extension of the cover over the pool.

A cable, e.g. a rope, is secured on its first end to the cable collecting reel. The cable is directed to a pulley means positioned proximate the opposing second end of the pool. The cable is trained about the pulley means and is then directed to its securement to the second end of the cover. The portion of the cable which extends between the pulley means and the second end of the cover is denominated the "return run" of the cable. The portion of the cable which extends from the reel to the pulley means is called the "outward run". The cable is extended outwardly away from the reel run. In some embodiments, the "outward run" of the cable may be positioned over the pool at an elevation well above the anticipated height of any user of the pool. In other embodiments the outward run of the cable may extend to the pulley means without passing over the pool. This positioning of the outward run permits the cable to be positioned so as to avoid physical obstacles at the particular swimming pool site.

The return run of the cable extends over the pool in the cover's direction of travel during its retraction. The cable is free from contact with the cover except at its connection to the cover at the end of the cover.

Since the drum may be mounted elevationally above the pool, it follows that as the cover is removed from the drum it will descend to the pool. During the process of extending the cover over the pool, the cover collecting drum is free wheeling about the drive shaft of the drive assembly. During this process, the drive shaft is engaged with the cable reel. Although the cover is fabricated of lightweight and buoyant materials, still the large size of the cover results in it being very heavy.

It has been found that during the procedure of removing the cover from the drum, the weight of the cover causes the cover to rapidly peel off of the drum at an uncontrolled rate, eventually causing the cover to form a pile at the pool's edge. This is largely due to the free wheeling mounting of the drive during the extension procedure. This phenomena complicates and may obstruct the operation of the drive assembly. Further, should the end of the pool at which this piling occurs be fitted with upstanding structures, such as diving boards or ladders, the operation of the drive assembly may be totally frustrated in that the piled cover would be tangled up with that structure during the cover extension procedure.

In order to control the rate of the removal of the cover from the drum, the invention includes a brake means associated with the cover collecting drum. This brake means is adapted to impart a drag force to the drum sufficient to preclude the uncontrolled removal of the cover from the drum. Further this brake means, in association with the cable, permits the user to control the angle of descent of the cover from the drum. The user may therefore adjust the angle of descent of the cover to avoid the cover's contacting any structure which may be located at the pool's edge.

The braking means may be fitted with a control means adapted to vary the amount of drag force being applied to the drum. In one embodiment, a control means is adapted to vary the drag force responsive to the quantity of cover fabric which has been removed from the drum.

In some embodiments, the last several feet of the cable proximate the second end securement to the cover's end is supplemented or replaced by an elastic cable, e.g. of the type conventionally denominated a bungee or shock cord. The use of an elastic cable at this location provides a very beneficial result. The length of the cable is dimensioned such that during the retraction of the cover all of the cable is taken off of the reel before the cover has been completely collected on the drum. As the cover collecting drum continues to rotate and collect the remaining portion of the cover thereon, the cable is tensioned by the action of the cover collecting drum's pulling on the cover.

In some orientations, the outward run of the cable is positioned elevationally well above the height of an anticipated pool's user. In contrast, the return run of the cable which extends from the pulley means to the second end of the cable, is positioned proximate the level of the water of the pool since the cable is connected at its second end to the second end of the cover which is positioned to float on the surface of the water. As the cover is retracted from off of the pool and the cable is tensioned, the return run of the cable, owing to the incorporation of an elastic member, is forcedly raised upwardly from the pool surface to an elevation proximate the location of the outward run of the cable. In this way, the invention positions both runs of the cable at a location which minimizes the chance of their coming into contact with a pool user.

The instant invention also contemplates embodiments which are adapted to cover pools having widths of large dimension. In these embodiments a plurality of cover collecting drums are spacedly positioned proximate one end of the pool to extend along the end of the pool. Each drum may be associated with a respective drum motor. Alternatively, a plurality of cover collecting drums may be associated with a single drive motor.

The cover collecting drums may be positioned to extend along a common horizontally extending axis. Alternatively the drums may be disposed in a staggered array, i.e. along disparate axes which extends along the end of the pool. One of the drums, preferably a drum that is centrally positioned among the other drums is fitted with at least one cable collecting reel. This particular drum is also fitted with an interconnection means which is adapted to engage and drive the cable collecting reel in one condition while permitting the cover collecting drum to remain free wheeling about the drive shaft. In a second condition the interconnection means causes the motor to forcedly drive the cover collecting drum while the cable collecting reel remains freewheeling about a drive shaft.

The covers, each of which is associated with a respective drum, may be interconnected to one another. Alternatively, each cover may be free of contact with other covers. In one embodiment, the covers may be interconnected by means of a single elongate shaft which is inserted through a channel formed in each of the ends of the various covers. Each channel may be formed by means of a hem. The covers are positioned adjacent one another to form a linear array. The hem channel of each cover is positioned in register with the hem channel of an adjacently positioned cover. A single elongate shaft is inserted through the aligned channels to extend through all of the covers and form a single leading edge for all of the associated covers. A cable which is affixed to the cable collecting reel on the drive assembly is extended outwardly from the reel in a manner similar to the cable previously described. The cable is secured at its second end to the leading edge of the assembly of covers in multiple motor assemblies. The various motors may be operated in unison to retract the assembly of covers from off of the pool. Alternatively, each motor may be operated independently to retract its respective cover without relation to other drive assemblies.

DETAILED DESCRIPTION OF THE ILLUSTRATED EMBODIMENT

Figure 1:
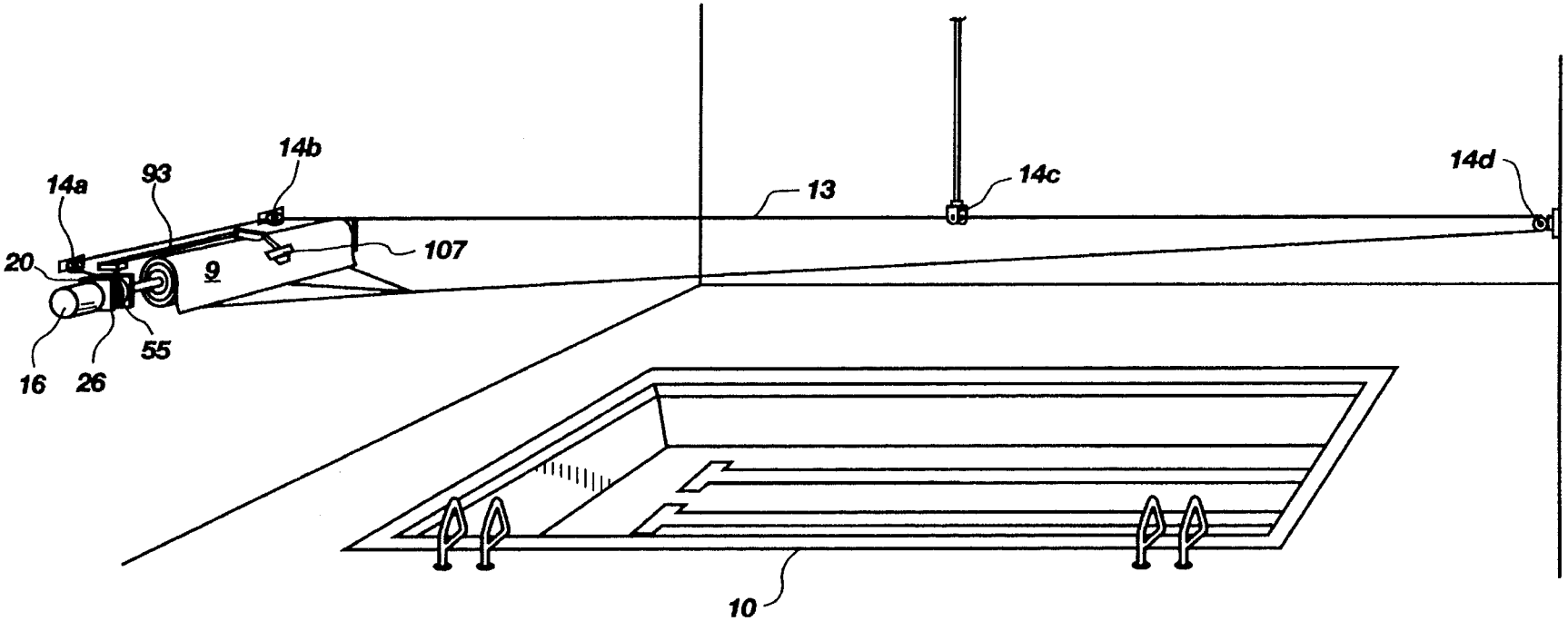
FIG. 1 is an elevated perspective view of a swimming pool fitted with a swimming pool cover apparatus of the instant invention.
Figure 2:
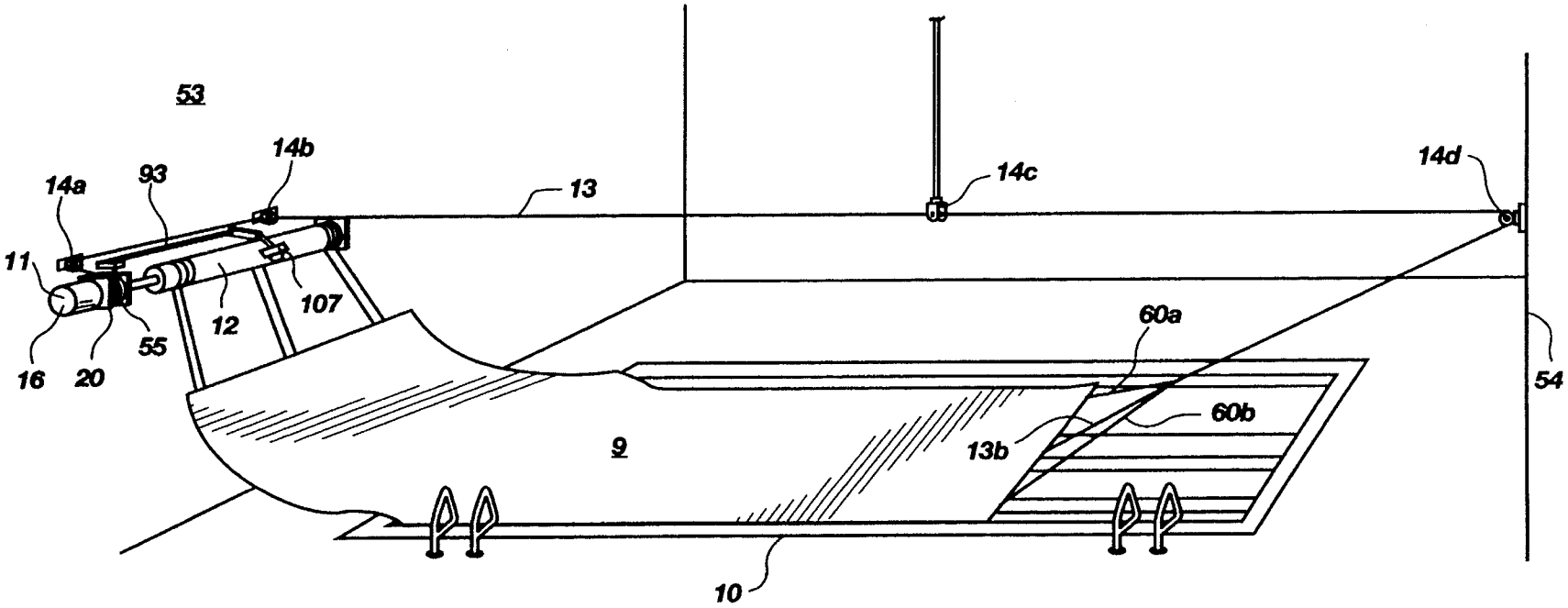
FIG. 2 is an elevated perspective view of the swimming pool of FIG. 1 with the cover apparatus partially extended.
Figure 3:
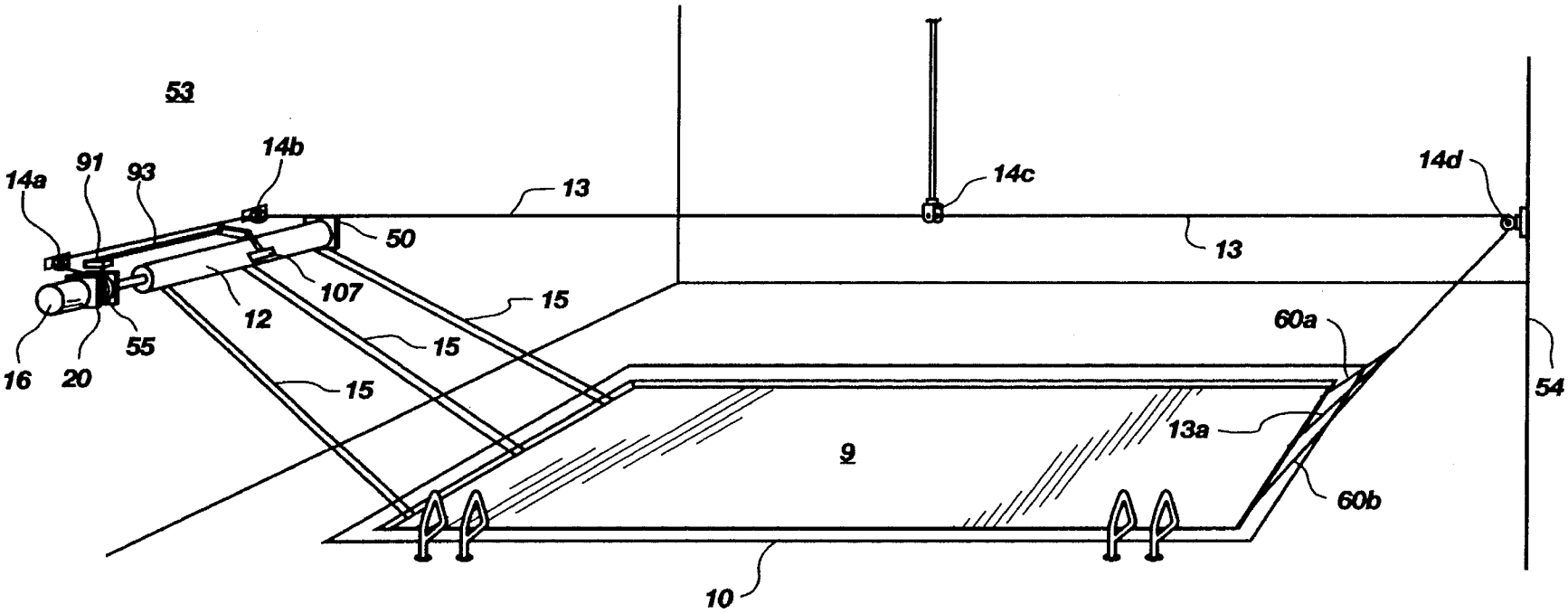
FIG. 3 is an elevated perspective view of the swimming pool of FIG. 1 with the cover apparatus in a completely extended condition.

As illustrated in FIGS. 1 through 3 the invention includes a flexible fabric cover 9 which is adapted to be extended over or retracted from a swimming pool 10. The cover 9 is adapted to be collected on a cylindrical collection drum 12 which is mounted to a motorized drive assembly 11. A cable arrangement 13 extends from the drive assembly 11 and is secured to the cover 9 at its free end.

The Cover

Figure 9:
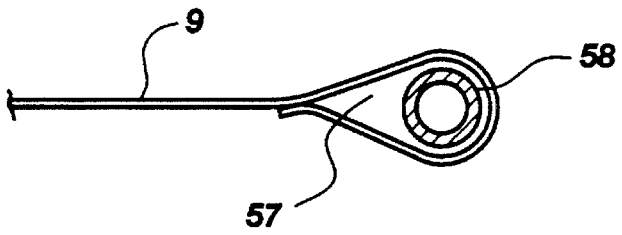
FIG. 9 is a cross sectional side view of the leading edge of the cover of the instant invention.

The cover of the invention is preferably fabricated from a flexible fabric such as polyethylene. In one embodiment, the polyethylene forms a substrate on which is adhered a synthetic foam layer which is adapted to render the cover buoyant when it is placed in water. The cover is preferably configured in a rectangular shape. The length of the cover is sized to correspond with the length of the pool to be covered. As shown in FIG. 9, the free end of the cover is turned over on itself and is secured to itself to form a hem. The hem defines a hollow channel 57 which extends along the entire free end of the cover. A rigid member 58 is inserted into the channel 57. In preferred constructions the member 58 extends substantially across the complete width of the cover. The member 58 rigidifies the end of the cover and forms a leading edge for the cover.

The Drive Assembly

Figure 4:
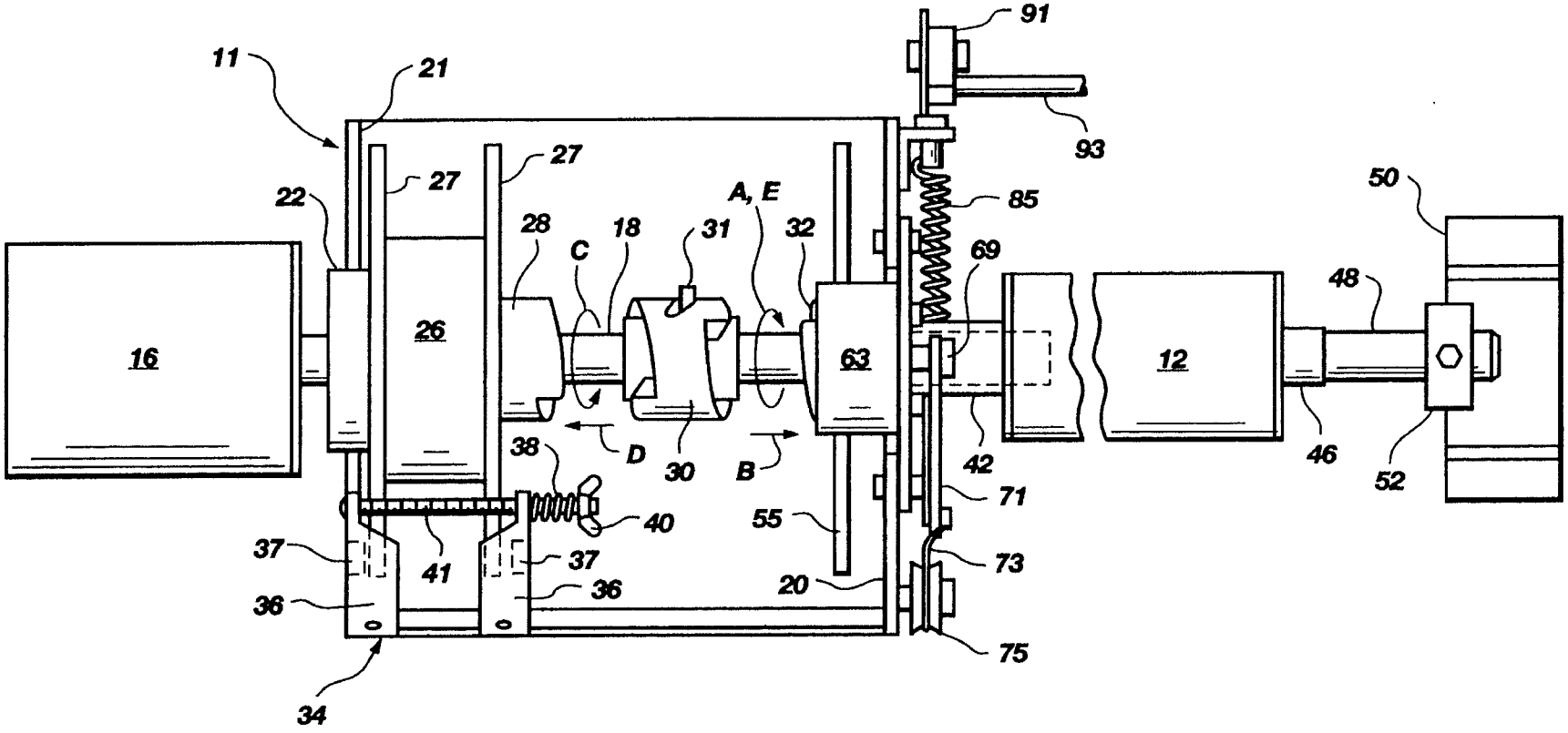
FIG. 4 is a front view of the drive assembly of the instant invention.

The drive assembly of the cover apparatus is shown in FIG. 4. As shown, the assembly is mounted to a box-like bracket support 20. The support 20 includes two planar vertically oriented panels 21 which are spacedly positioned parallel to one another. Each of the panels 21 defines a slot therein which is dimensioned to receive and retain a bushing assembly. A bushing 22 is positioned within a slot of the panel 21*a* and a bushing 24 is mounted within a slot defined in panel 21*b*. Each of the bushings defines a cylindrical aperture which extends through the complete thickness of the bushing. A cylindrical drive shaft 18 journaled through the bushings in the drive shaft passes through the apertures of the bushings. One end of the drive shaft 18 is connected to a motor 16. The opposing free end of the drive shaft 18 is received and retained within the cylindrical channel defined by an end fitting 42 of the cover collecting drum 12.

A cylindrical reel 26 is rotatably mounted onto the drive shaft 18 proximate the bushing 22. The reel 26 is adapted to be free wheeling about the drive shaft 18. The reel 26 includes two disk shaped panels 27 which are spacedly positioned from one another to form the outer structure of the reel.

A brake assembly 34 is pivotedly mounted on the support 20. The brake assembly is adapted to intercooperate with the disk panels 27 and forms a means of producing a drag force on the reel 26. As shown, the brake assembly 34 includes a pair of extensions 36. Each of the extensions is pivotedly mounted to the support 20 on one of its ends. Fitted on the interior facing surface of each of the arms 36 is a block of material 37 having a high coefficient of friction, e.g. a synthetic plastic block. Each of the opposing free ends of the pair of extensions 36 defines an aperture therethrough which is dimensioned to receive a male threaded bolt 41. The head of the bolt 41 engages against the exterior facing surface of one of the extensions 36 to retain the bolt in position. The opposing end of the bolt passes through the aperture in the other extension 36. A spring 38 is disposed on the bolt 41.

The spring 38 engages the exterior facing surface of the extension 36*b* on one of its ends. The opposing end of the spring 38 engages a female threaded wing nut 40 which is threaded onto the end of the bolt 41. As the wing nut is threaded onto the bolt 41, the two extensions 36 are urged toward each other thereby bringing the blocks of material 37 into a friction engagement against the upright side panels 27. The friction engagement can be adjusted by either tightening or loosening the wing nut 40.

Fixedly mounted on the disk 27*a* of the reel 26 is a single dog gear 28. The single dog is rotatably mounted on the drive shaft 18 and is freewheeling about the drive shaft. The single dog is fixedly attached to the disk 27*a*. A double dog gear 30 is also rotatably mounted on the drive shaft 18 to be freewheeling about the drive shaft. The opposing gear faces of the single dog 28 and the double dog 30 are configured to register and mesh with one another upon the two gears being brought into abutment.

The double dog 30 defines an angulated slot which extends through a thickness of the double dog 30. The longitudinal axis of the slot is oriented at an angle to the longitudinal axis of the double dog 30. A shear pin 31 is secured into the drive shaft 18 to extend orthogonally outward from the drive shaft 18. The shear pin 31 extends into the slot formed in the double dog 30. It follows that as the drive shaft 18 is rotated in the direction shown by arrow A the double dog gear 30 is displaced longitudinally along the length of the drive shaft 18 in the direction of arrow B by the interaction of the shear pin 31 in the slot of the double dog gear. Likewise, a rotation of the drive shaft in the direction indicated by arrow C would effect a longitudinal displacement of the double dog 30 in the direction of arrow D along the drive shaft 18.

The cover collecting drum 12 is a generally tubular, cylindrical member. Each of the opposing ends of the drum is fitted with an end housing 42 which is adapted for mounting the drum to the drive shaft 18 or to an extension of the drive shaft.

Each end housing 42 includes a circular disk shaped section and a cylindrical tubular section which is mounted on the disk shaped section to extend outwardly therefrom. The tubular section defines an elongate channel therein which is dimensioned to receive the drive shaft 18. The disk shaped section also defines an aperture which is in register with the channel of the tubular section. The end housing is adapted to be positioned on the drive shaft and be free wheeling about the drive shaft. The end housing extends through the aperture of the bushing 24 and is free wheeling within that bushing. Fitted fixedly on the end of the end housing 42 is a single dog gear 32. The opposing gear faces of the single dog 32 and the double dog 30 are adapted to register and mesh upon the two gears being brought into abutment.

The end housing 46 which is mounted on the opposing end of the drum 12 defines a disk shaped section and a cylindrical tubular section similar to end housing 42. An elongate cylindrical shaft 48 is inserted into the channel formed by the tubular section of the end housing 46. In preferred constructions the shaft 48 is fixedly secured to the end housing 46. The shaft 48 is journaled through a bushing 52 to be freewheeling therein. Bushing 52 is mounted securely in an end support 50.

As shown in FIGS. 1–3 the supports 20 and 50 may be secured to an upright vertical wall 53. The motor 16 may be secured to the wall 53. Preferably the motor 16 may be secured to the support 20. As the motor is operated the double dog 30 is either displaced to the left or to the right depending on the particular rotation of the drive shaft 18. When the drive shaft is rotated in the direction indicated by arrow A the double dog 30 is displaced to the right resulting in the right gear face of the double dog engaging and meshing with the gear face of the single dog 32. Further rotation of the drive shaft 18 causes the drum 12 to be rotated in the direction of arrow E. This results in the cover 9 being collected onto the drum 12. Since the reel 26 is free wheeling about the drive shaft in this particular condition any cable collected on that reel may be extended off of the reel responsive to tension placed on the cable by the displacement of the cover.

A drive shaft rotation in the direction indicated by arrow C causes the double dog gear 30 to be shifted to the left thereby bringing the left gear face of the double dog 30 into engagement and abutment with the gear face of the single dog 28. A continued rotation of the drive shaft 18 causes the reel to be rotated in the direction indicated by arrow G. This rotation of the reel 26 causes the cable 13 to be collected onto the reel 26. Since the drum 12 is free wheeling about the drive shaft 18 in this condition the cover may be drawn off of the drum by the cable pulling on the leading edge of the cover.

Figure 7:
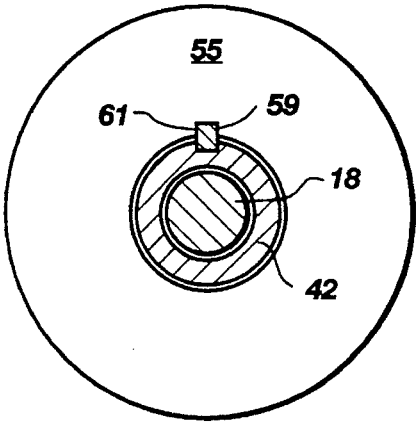
FIG. 7 is a cross-sectional view of the drive shaft of the drive assembly illustrating the mounting of the brake disk on the drive shaft.
Figure 8:
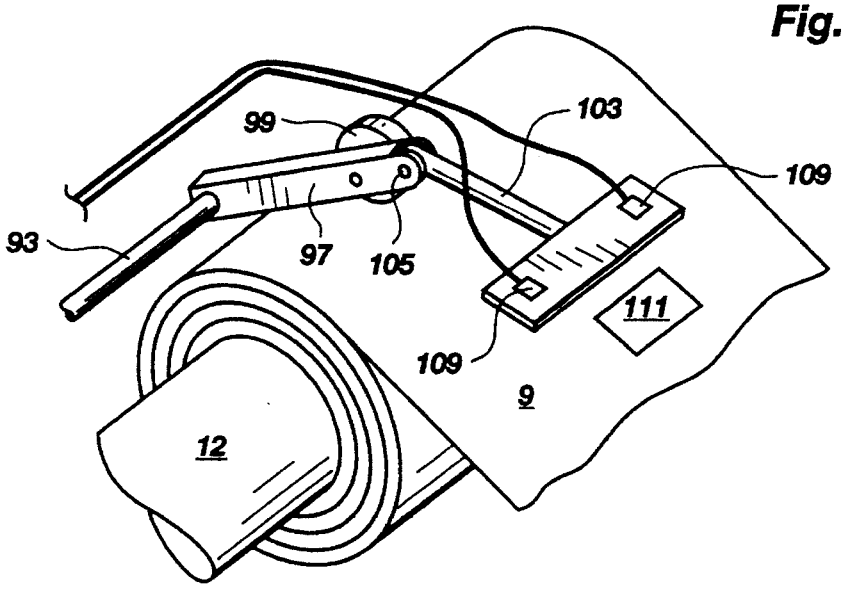
FIG. 8 is an elevated perspective view of the cover collecting drum, cover and roller-fitted actuation arm of the brake assembly.

FIG. 4 illustrates the drive assembly in more detail. As shown, the end housing 42 may be fitted with a circular, planar disk 55 which is fixedly secured to the end housing 42 by means of a key slot union 61. This union 61 is shown in detail in FIG. 7 where the end housing 42 is shown as including an upstanding key extension 59 which is slidably received in a key slot 61 defined in the disk 55. The disk is preferably fabricated from a sturdy metal such as stainless steel. The key union established a fixed union of the disk 55 and the end housing 42.

Figure 6:
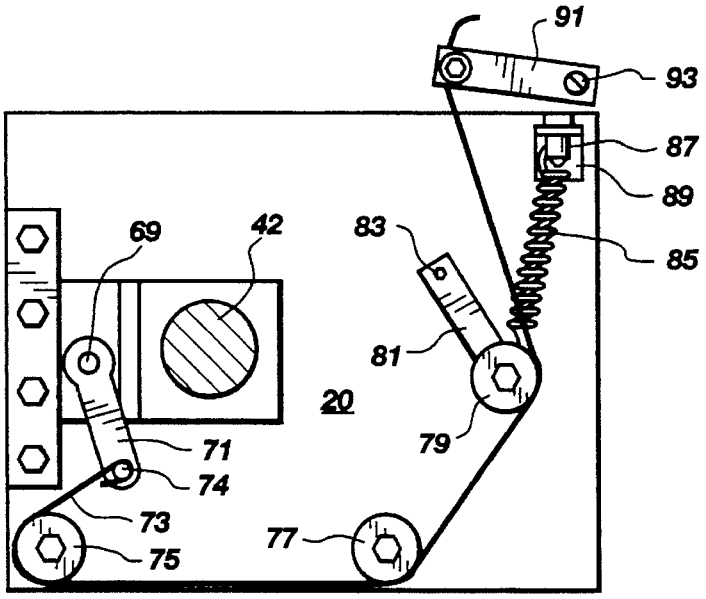
FIG. 6 is a side view of a section of the brake assembly.

Mounted about the disk 55 is a caliper or disk brake assembly 62. As shown in FIG. 4, this brake assembly 63 includes two caliper members 65 which are positioned spacedly apart from one another about the disk 55. The calipers 65 are adapted to be urged and displaced toward one another thereby sandwiching the disk 55 therebetween and applying a drag force on the disk by means of pads 67 mounted on the inner faces of the calipers contacting the disk 55. In one preferred construction, a caliper brake assembly of the type commonly used on snowmobiles is used. The action of the brake calipers is controlled by a novel control structure. The action of the calipers is controlled by the rotation of a control shaft 69. This shaft 69, shown to advantage in FIG. 6, is fitted with an actuating arm 71. A cable 73 is secured to one end of arm 71. As shown, the cable 73 is tied to a shaft extension 75 which extends laterally from the arm 71. The cable 73 is trained about pulleys 75 and 77, which are rotatably secured to the side of bracket 20. The cable 73 is then trained about third pulley 79 which is rotatably mounted on a support arm 81. The support arm 81 is pivotedly mounted to the bracket 20 by pivot pin 83. A coil spring 85 is mounted on one of its ends to the support arm 81 proximate the mounting of the pulley 79 on that arm. The opposing end of the spring 85 is mounted to a male threaded bolt 87 which is threadedly inserted in a female threaded bracket 89 secured to the side of bracket 20. The positioning of the bolt 87 determines the amount of tensioning which is applied to spring 85. Inserting the bolt 87 farther into the bracket 89 reduces the tension on spring 85. Retracting the bolt 87 from the bracket increases the tension on the spring. The tension on the spring 85 controls the force being exerted on the support arm 81 and hence the positioning of that support arm.

The support arm 81 is utilized to tension the cable 73 and retain that cable in a taut condition. The end of cable 73 is fixedly secured to one end of actuating arm 91. The opposing end of the actuating arm 91 is fixedly secured to the end of an elongate rod 93 which is oriented to extend laterally from the opposing end of arm 91.

Figure 5:
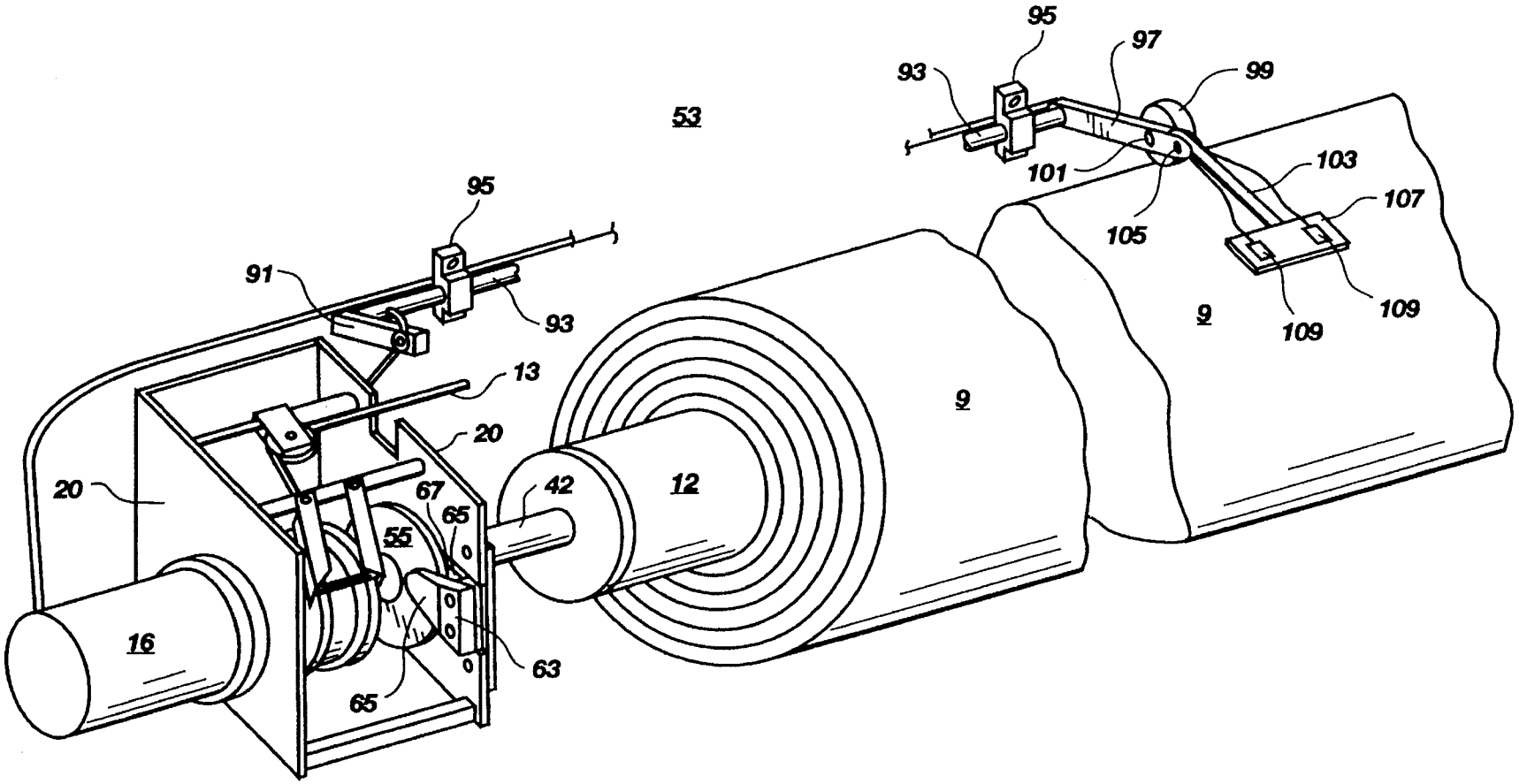
FIG. 5 is an elevated sectional perspective view of the drive assembly shown in FIG. 4 illustrating the roller-fitted actuation arm of the brake assembly.

As shown in FIG. 5, rod 93 is rotatably mounted in a pair of retaining brackets 95 which are secured to wall 53. The opposing end of rod 93 is fixedly secured to an arm 97 which extends laterally from the rod 93. A roller or wheel 99 is rotatably mounted to the arm 97 by means of an axle 101 which extends laterally from the arm 97. The roller 99 is adapted to engage the cover 9 which has been rolled onto the cover collecting drum 12. Sensor arm 103 is pivotedly mounted to the actuating arm 92 by pivot pin 105. Mounted on the end of sensor arm 103 is a platform 107 fitted with a pair of conventional reed switches 109. The reed switches are adapted to sense the passage beneath them of a magnetic element 111 implanted in the cover 9. The switches 109 are wired to an automatic shut off switch associated with motor 16. The cover 9 is fitted with two elements 111. One element is positioned proximate each of the opposing ends of the cover 9. It follows that as the cover is extended, the element 111 positioned proximate the cover 9's attachment to the drum 12 activates the switches 109 to cause the motor to shut off. As the cover is retracted, the element 111 positioned proximate the free end of the cover 9 causes the motor to be shut off.

In operation, the elevation of the sensor arm 103 is a function of the quantity of cover 9 wrapped about the cover collecting drum 12. The sensor arm 103 rides atop the cover 9 by virtue of the roller 99. As the diameter of the cover roll decreases or increases, the sensor arm is lowered or raised respectively. As the elevation of the sensor arm 103 changes, the sensor arm 103 causes the rod 93 to rotate about its longitudinal axis. This rotation, in turn, causes the actuating arm 91 to be rotated about that same longitudinal axis. The rotation of arm 91 causes the arm 71 to be rotated about shaft 69. The rotation of shaft 69 causes the calipers of the disk brake to be either urged toward or away from the disk 55, depending on the direction of rotation of shaft 69. As the sensor arm 103 is elevationally lowered, the calipers are urged outwardly away from the disk 55 thereby decreasing the drag force on the disk 55. As the sensor arm 103 is raised elevationally, the calipers are urged toward the disk 55 thereby increasing the drag force on the cover collecting drum.

The operation of the brake 63 is adapted to apply an increasing amount of drag force on the cover collecting drum as more of the cover is wrapped about the drum. The drag force can be adjusted such that upon the double dog being disengaged from the single dog gear mounted on the cover collecting drum end casting, the cover is not immediately peeled off of the drum due to the weight of the cover acting on the drum. As the double dog 30 shifts to engagement with the cable collecting reel 27 and begins to collect the cable 13 on the reel 27, the cable 13 imparts a force to the cover 9 sufficient to overcome the drag force being imparted to the cover collecting drum 12 by the brake assembly 56. With proper adjustment of the brake assembly 63, the user may adjust the incline of the portion of the cover 9 being retracted from the drive relative to the pool 10 below. Adjustment of this incline permits the user to withdraw the cover 9 without impacting the cover against upstanding structure positioned about the perimeter of the pool, e.g. diving boards or ladders.

Reverting to FIG. 1 the combination of the drive assembly, the cover 9 and the cable arrangement 13 is shown in detail. As illustrated, the cover 9 is secured to the drum 12 by means of a plurality of fabric straps 15. These straps are secured on their respective first ends to the drum 12 and on their second ends to the cover 9. The straps are positioned spacedly from one another along the end of the cover 9. Alternatively, the cover 9 may be attached directly to the drum 12.

The cable arrangement includes a cable 13, preferably nonstretchable, which is secured at its first end to the reel 26. The cable extends outwardly from the reel 26 and is trained about a first pulley **14*a* which is mounted to the wall 53. The cable then extends to a second pulley 14*b* which is likewise mounted to the wall 53. The cable then extends over and above the pool to be covered. The cable 13 is trained about a third pulley which may be suspended from the ceiling of the facility housing the pool. The cable 13 is then trained about a fourth pulley 14*d* which is mounted on an upright wall 54 which is opposite the wall 53. The cable 13 is then directed to the leading edge of the cover 9** where it is secured to the cover.

In preferred constructions the pulleys **14*b*, 14*c*, and 14*d* are positioned to cause the cable 13 to extend over the pool 10 substantially parallel with the longitudinal axis of the pool 10. In some constructions the cable 13 is oriented to extend along a line which is within a vertical upright plane which also includes the longitudinal axis of the cover. Furthermore, the cable 13 in preferred constructions is mounted to the cover's leading edge at or near the center point of the leading edge as shown in FIG. 1**.

Figure 10:
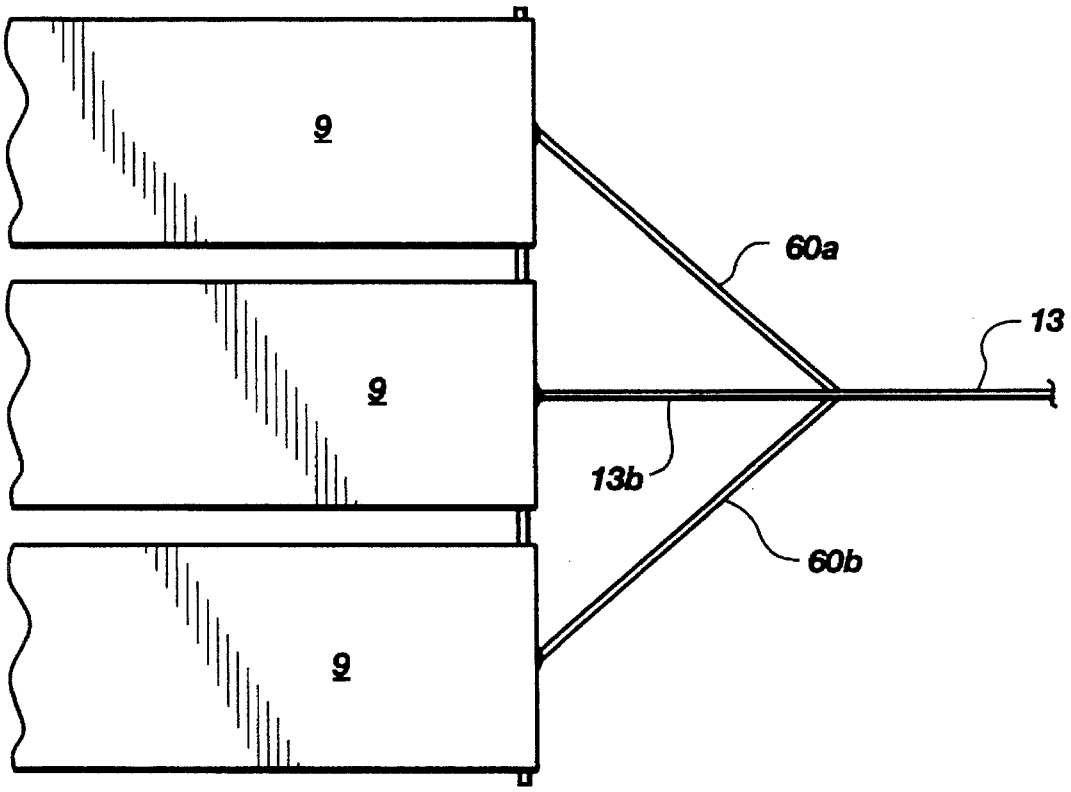
FIG. 10 is an elevated perspective view of an alternative embodiment of the cover apparatus of the instant invention.

The cable 13 may be modified to achieve an optimized operation. In this particular embodiment the section of the cable proximate the second end of the cable i.e. proximate the mounting of the cable to the leading edge of the cover 9, is replaced by a section of elastic or shock cord 60. The cord 60 is mounted on its first end to the leading edge of the cover 9. The cord 60 is mounted on its second end to the cable 13. In a preferred construction illustrated in FIG. 10, the cord 60 is formed by two elements, a first length **60*a* and a second length 60*b* which forms a bifurcated or forked arrangement. Each length is secured to the cable 13 on a first end and is secured to the leading edge of the cover 9 at its second end. The securements of the second ends of the lengths are spacedly positioned from one another. A length of cable 13*b* may be secured at its first end to the cable 13 at the point of securement of the first ends of the lengths 60*a* and 60*b*. The second end of the cable 13*b* is secured to the leading edge of the cover 9 at a location positioned between the securements of the second ends of the lengths 60*a* and 60*b*. Cable 13 and 13*b* may be an integral cable. Preferably, the cord 60 is mounted such that the cable 13*b* is slack while the lengths 60*a* and 60*b* are drawn taut when tension is placed on the cable 13. Only when the lengths 60*a* and 60*b* are placed under a preselected tension, less than the rupture or fracture strength of those lengths is the cable 13*a* drawn taut to the point that it assumes some of the tension being imparted to the tensioned cable 13. Cable 13*b* functions to safeguard the shock cord length 60*a* and 60*b*** from being over-tensioned.

The use of the cord 60 effects a novel operation of the cover apparatus. In those embodiments which incorporate a cord 60 the length of the cable/cord assembly is sized such that as the cover is being retracted from the pool the complete length of the cable/cord assembly is taken off of the reel 26 prior to the drum 12's having completely collected the entire cover thereon.

It follows that as the drum 12 continues to rotate under the power of the motor 16, the cover continues to be drawn off of the pool. Since the length of the cable/cord assembly can not be extended by drawing off more cable from the reel 26 the powered drawing off of the cover 9 causes the cable/cord assembly to be stretched or tensioned. Due to this tensioning and the reactive forces imparted by the cord 60, the cable/cord assembly is elevationally raised as more tension is added to the assembly. As the cover is finally fully collected onto the drum 12, the cable/cord assembly has been drawn into the configuration shown in FIG. 1. This elevational positioning of the cable/cord assembly is highly beneficial in that it orients the assembly at a height which minimizes the opportunity for a pool user to contact the assembly during the use of the pool.

The cover 9 may also be fitted with a weight which preferably takes the form of an elongate shaft which is positioned within a hem formed in the leading edge of the cover. A cross-sectional view of the cover in FIG. 9 illustrates this construction. This weight is adjusted dimensionally to achieve two functions. First, the weight is adapted to accelerate the downward displacement of the cover 9 off of the drum during the extension procedure. Owing to the considerable weight of the cover 9, it may be desirable to supplement the cable 13 in supporting the cover 9 at the first opportunity after the cover 9 leaves the drum 12 to reduce the amount of force which must be applied to the cover 9 by the motor 16. In the instant invention, the buoyance of the cover 9 itself is utilized to reduce the effective weight of the cover 9. Accordingly, it is important that the cover 9 be brought into contact with the water in the pool 10 as soon as possible after the cover has been extended off of the drum 12. By placing a weight of a dimension adapted for the particular cover weight, the user is able to immediately direct the cover downward into engagement with the water in the pool and thereby bring the buoyancy force of the water into application on the cover. This in turn reduces the amount of force that the motor 16 must apply to the cover in order to pull the cover across the pool.

As the cover reaches the opposing end of the pool and completes of the extension procedure, the weight serves to increase the angle 61 of the cable/cord assembly 66. This in turn causes the leading edge of the cover to be lowered down onto the water to effect a substantially complete covering of the pool. Absent the use of the weight, the cable would cause the leading edge of the cover to be suspended above the level of water in the pool thereby leading to a less than adequate covering of the pool.

Figure 11:
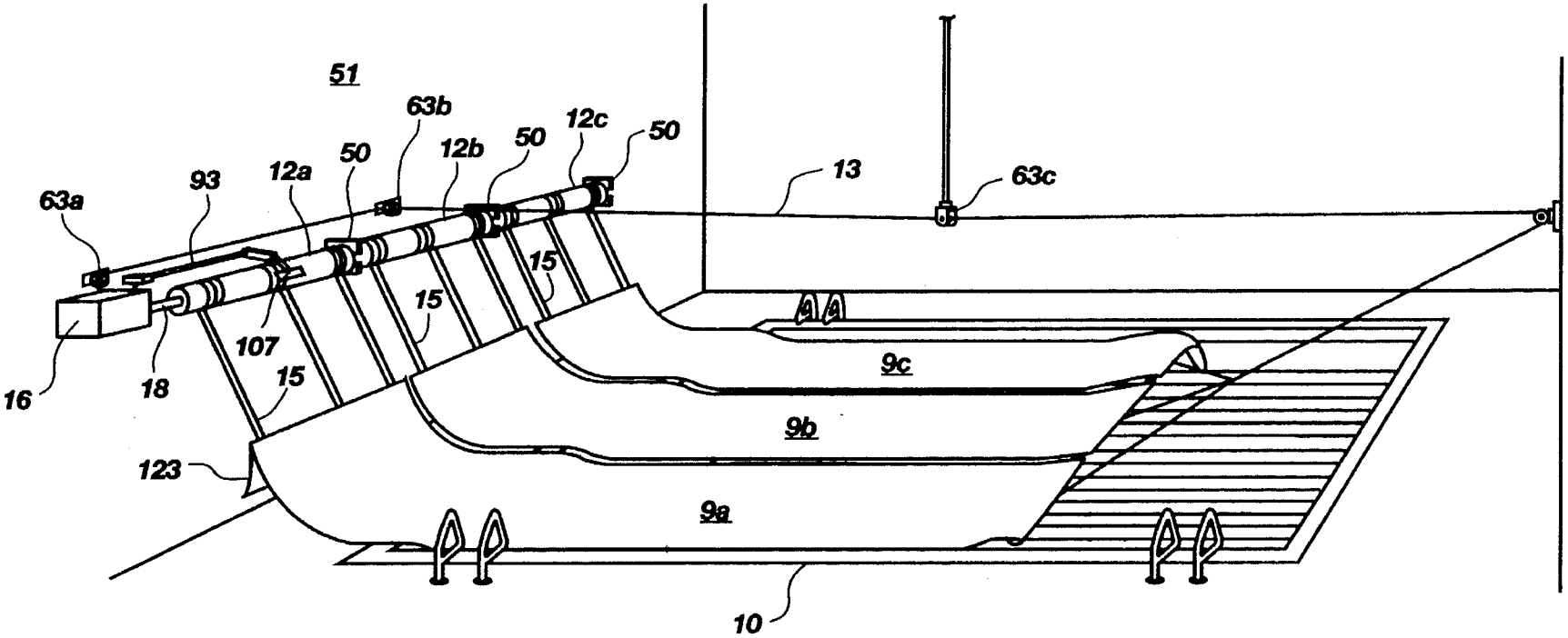
FIG. 11 is an elevated perspective view of a second alternative embodiment of the cover apparatus of the instant invention.
Figure 12:
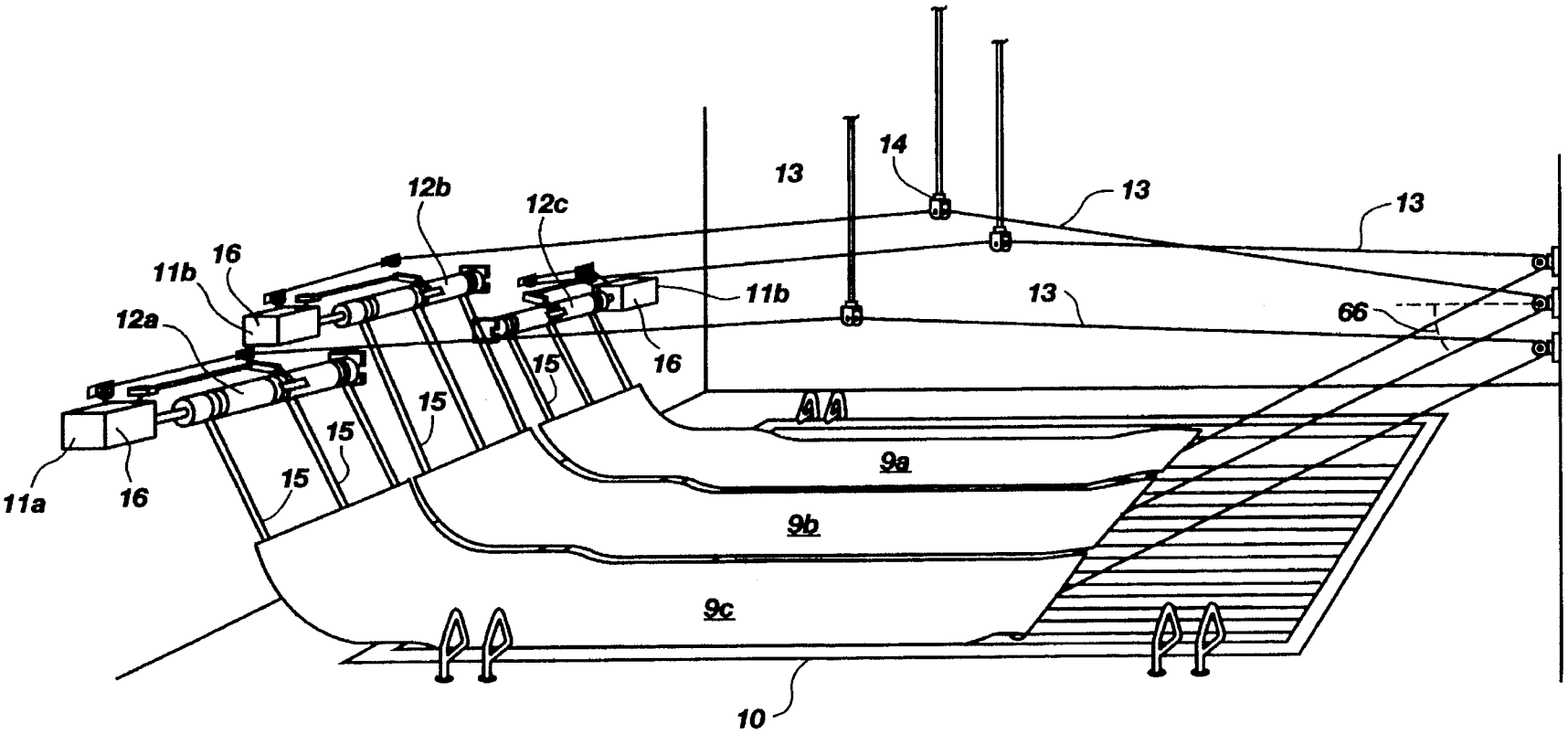
FIG. 12 is a top view of a cable arrangement of the invention.

FIGS. 11 and 12 illustrates alternative embodiments of the invention. In FIG. 11 two additional drums 12 have been associated with the principal drum 12*a* of the motor 16. In this embodiment the drive shaft extension 48 of the first drum 12*a* is fixedly secured to the endhousing 42 of the second drum 12*b*. Furthermore, the drive shaft extension 48 of the second drum 12*b* is fixedly secured to the end housing 42 of the third drum 12*c*. The end supports 50 between covers 9*a* and 9*b* and between covers 9*b* and 9*c* are each secured to the wall 51. The cable arrangement is similar to the cable arrangement of the embodiment of FIG. 1. The cable 13 is secured to a single reel 26 (not shown) which is mounted on the drive shaft 18 between the motor 16 and the drum 12*a*, pulleys 63*a*, 63*b*, and 63*c* are positioned to direct the cable in a path which is parallel with the longitudinal axis of the cover 9*b*. Further the cable path is preferably in a vertical plane which intersects the longitudinal axis of the cover 9*b*. As shown in FIG. 6 this embodiment may also be fitted with an elastic cord 60 and a weight 66.

In FIG. 11, the three covers 9*a*, 9*b*, and 9*c* are illustrated as being separate and distinct from one another. This permits them to each be individually collected about a respective drum 12. As shown to advantage in FIG. 6, the leading edges of the three covers may be joined together by means of a common rigid shaft member 58 which extends through all three of the channels formed by the leading hemmed edge of each cover. The channels formed in the three covers are positioned in register one with another and the rigid member 58 is then inserted through the aligned channels. The use of a single member 58 to form the leading edge of the covers permits a single attachment of the cable 13 to the leading edge.

FIG. 12 illustrates a second alternative embodiment of the instant invention wherein a plurality of covers are adapted to be extended over and retracted from a swimming pool. In this embodiment the apparatus is adapted to effect the extension or retraction of each of the covers individually over the pool.

Each drive assembly 11 is fitted with its respective motor 16 and a drive shaft 18 which is interconnected to the motor 16. A cover collecting drum 12 is mounted on the end of each drive shaft 18 to be free wheeling about the drive shaft. The drums 12 are each mounted to the drive shaft 18 by means of an end housing 42 of the type illustrated in FIG. 4. The opposing end of each drum 12 is fitted with an end housing 46 of the type shown in FIG. 4 Likewise each end housing 42 is fixedly mounted to a respective elongate cylindrical shaft 48 which is journaled through a bushing 52.

Each bushing 52 is secured into an end support 50 of the type shown in FIG. 4. All of the drive assemblies 11 are of the construction shown in FIG. 4. Each of the drive assemblies 11*a*, 11*b* and 11*c* include a respective reel 26 and a cable 13. Each of these drive assemblies include a double dog gear 30 and a pair of spacedly positioned single dogs. The slot and shear pin arrangement the double dog gear 30 in FIG. 4 is incorporated into each drive assembly. A single dog gear 32 is secured to the end of each end housing 42.

This embodiment does not utilize the previously described method of integrating the three covers at their respective leading edges through the use of a single elongate shaft 58. Instead, each cover 9 is independently extended and retracted over the pool without regard to the other covers 9.

One of the principal differences which separate the embodiment of FIG. 12 from the embodiment in FIG. 11 is the positioning of the drive assembly 11*b* elevationally above the other drive assemblies. In the embodiment of FIG. 11, the longitudinal axis of each drum 12 is positioned on a common horizontal axis, i.e. the longitudinal axes are collinear with one another. In contrast, in the embodiment of FIG. 12 the longitudinal axes of drive assemblies 11*a* and 11*c* are collinear but the longitudinal axis of the drive assembly 11*b* is not collinear. Instead the longitudinal axis of drive assembly 11*b* is parallel to the longitudinal axes of drive assemblies 11*a* and 11*c*, while being elevationally above those longitudinal axes. This staggered arrangement permits the drums 12 of adjacent drive assemblies to be positioned laterally close to one another notwithstanding adjacent drums are positioned vertically spaced from one another. It follows that the embodiment of FIG. 12 can be operated essentially similarly to the embodiment of FIG. 11 by adjusting the length of the straps 15.

It should be understood that the illustration of three covers in FIGS. 11 and 12 is merely illustrative. In fact, any number of covers could be arranged in side by side orientation to cover any sized pool. Observably in the embodiment of FIG. 12, it is preferable that every other drive assembly be mounted elevationally above the preceding drive assembly thereby duplicating the spatial relationship of drive assemblies 11*a* and 11*b*.

Figure 13:
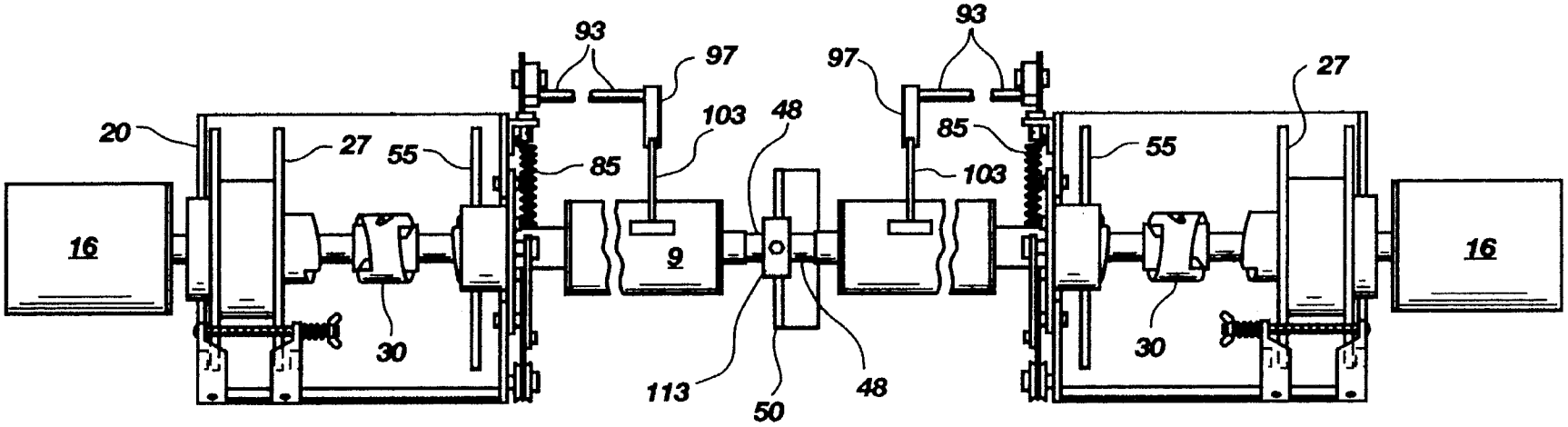
FIG. 13 is a front view of a multiple cover drive assembly.
Figure 14:
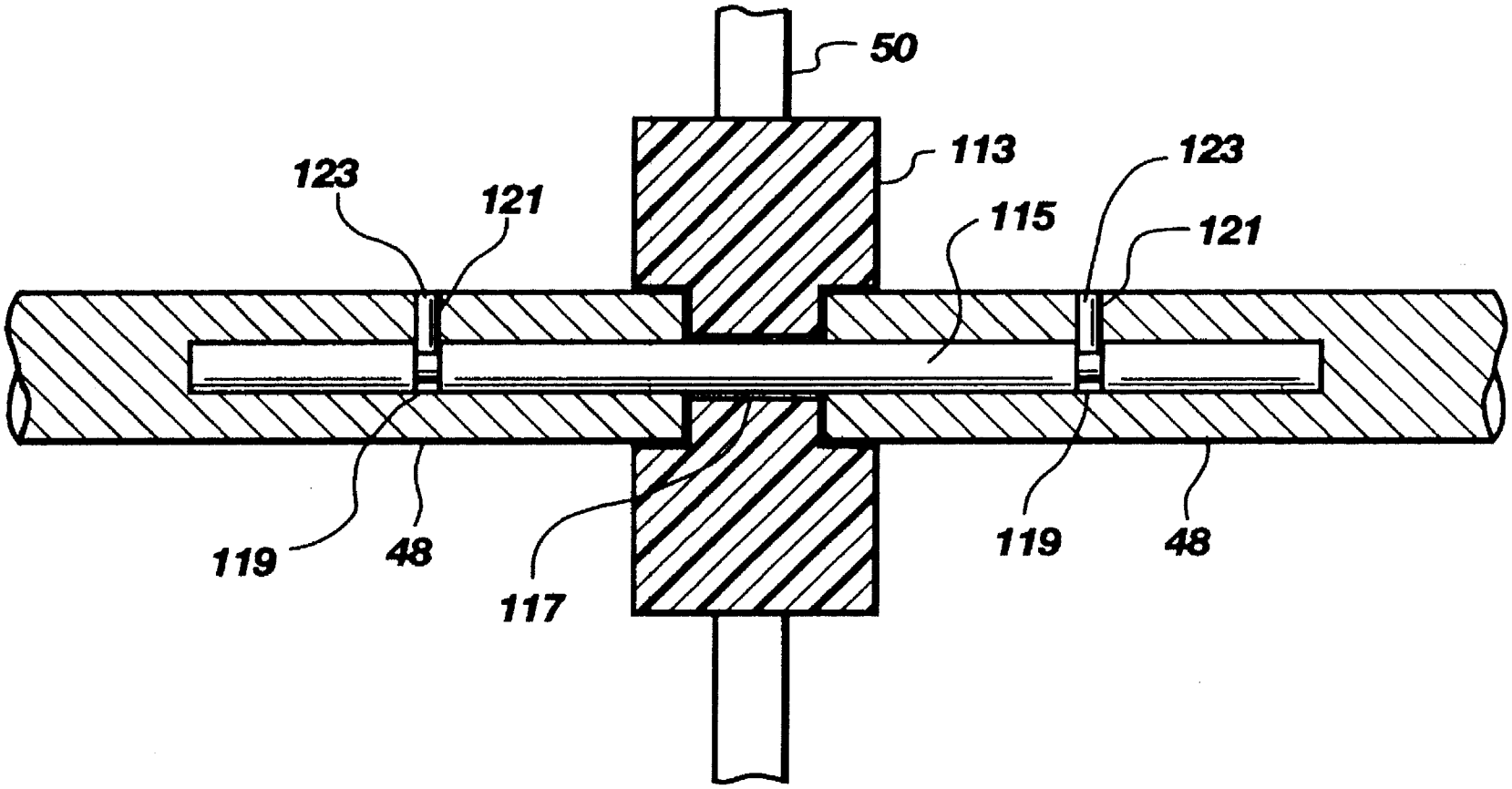
FIG. 14 is an alternative embodiment of the multiple cover drive assembly of FIG. 13 wherein two motors are mounted on the assembly.

FIGS. 13 and 14 illustrate an embodiment of the drive assembly wherein two cover collecting drums 12 are utilized. In this particular construction, each cover collecting drum 12 is intercooperated with its own respective motor drive assembly 11. Likewise, each drum is fitted with its own sensor arm 103 which is adapted to control the drag force being applied to each respective brake disk 55. FIG. 14 illustrates the center bushing 113 into which the ends of the support shafts 48 housings of the two cover collecting drums 12 are recessed and retained. As shown, each support shaft 48 is received within a respective recess well defined in the bushing 113. An elongate shaft 115 is received into a cylindrical longitudinal channel defined in each support shaft 48. The shaft 115 passes through a horizontally positioned channel 117 defined in bushing 113 and thereby intercommunicates the two support shafts 48. The shaft 115 defines two annular grooves 119 therein which are spacedly positioned from one another. Each support shaft 48 defines a lateral channel 121 configured to receive a shear pin 123. The shear pin is received into its respective groove 119 to form a union of the shaft 115 and a respective shaft 48. The construction shown in FIG. 14 permits each shaft 48 to rotate independently from the other.

Figure 15:
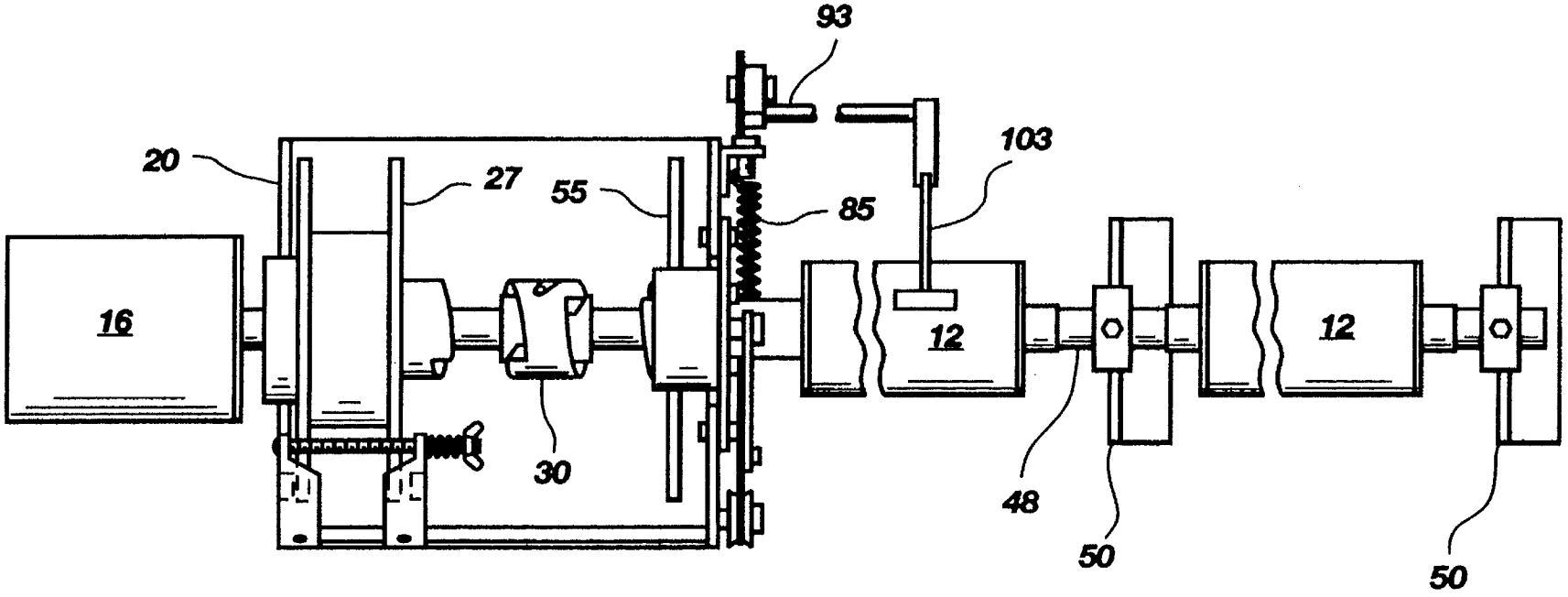
FIG. 15 is a sectional view of a support bearing assembly.

FIG. 15 illustrates a drum assembly wherein the two cover collecting drums 12 are linked together. In essence, the shaft 48 of drum 12*a* is integral with the shaft 48 of drum 9*b*. In an alternative construction, the assembly shown in FIG. 14 may be utilized to link the two drums 12. In this construction, the shear pins 123 would each be received in respective recess wells formed in the shaft 115. The channels 119 would be eliminated. *In this particular construction, the sensor arm 103 is mounted atop only one of the drums as illustrated.

Figure 16:
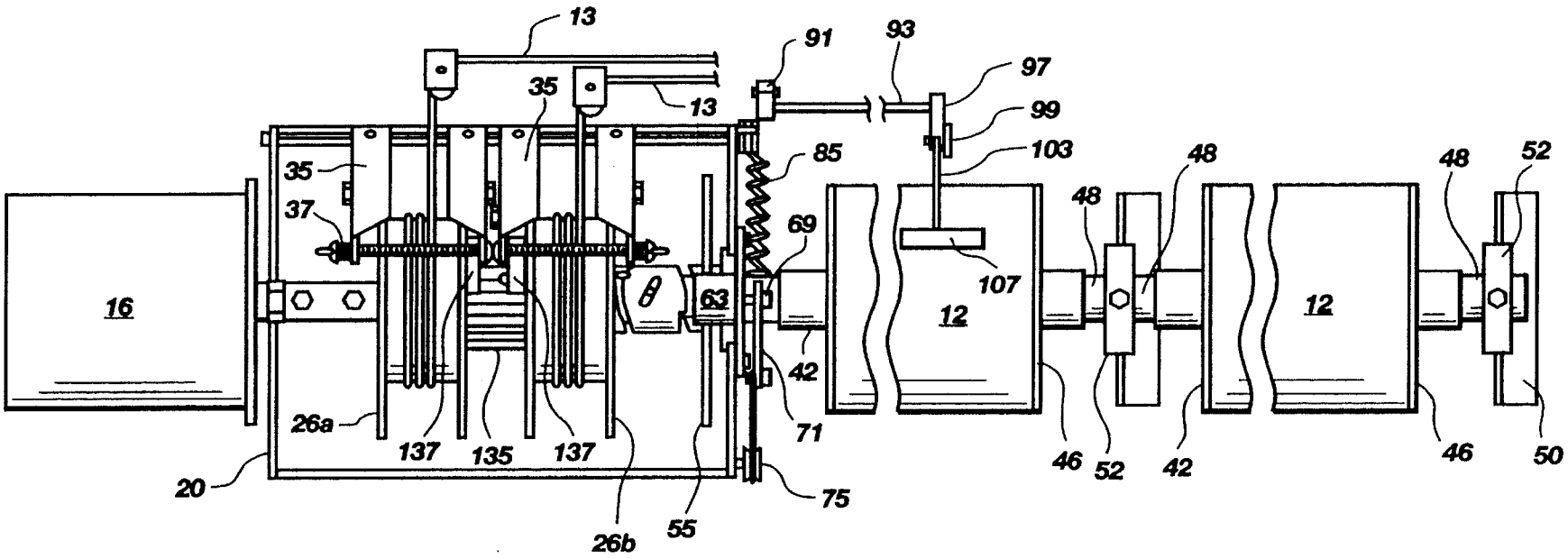
FIG. 16 is a front view of an alternative multiple cover drive assembly.
Figure 17:
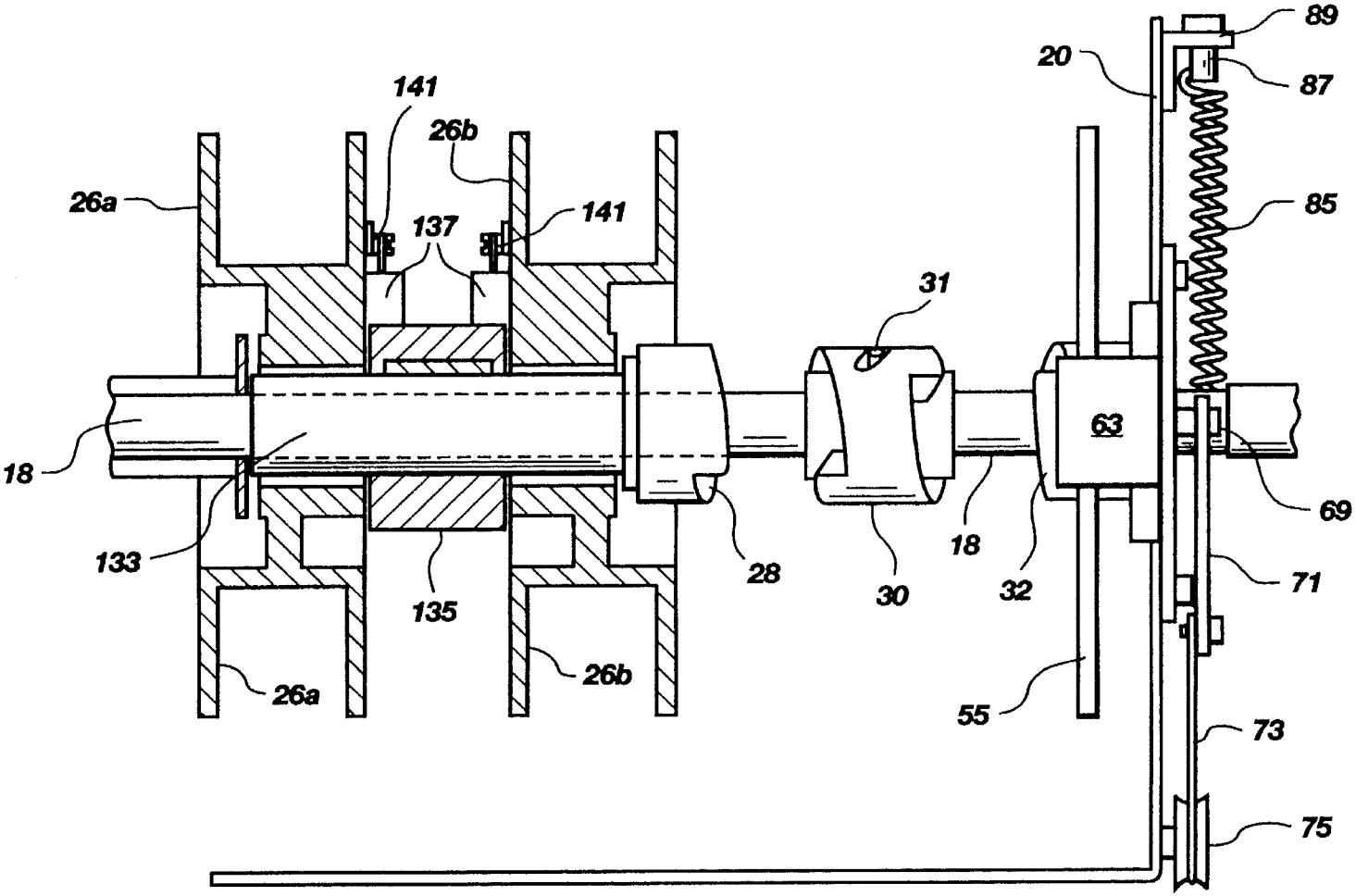
FIG. 17 is a sectional view of the drive assembly of FIG. 16.
Figure 18:
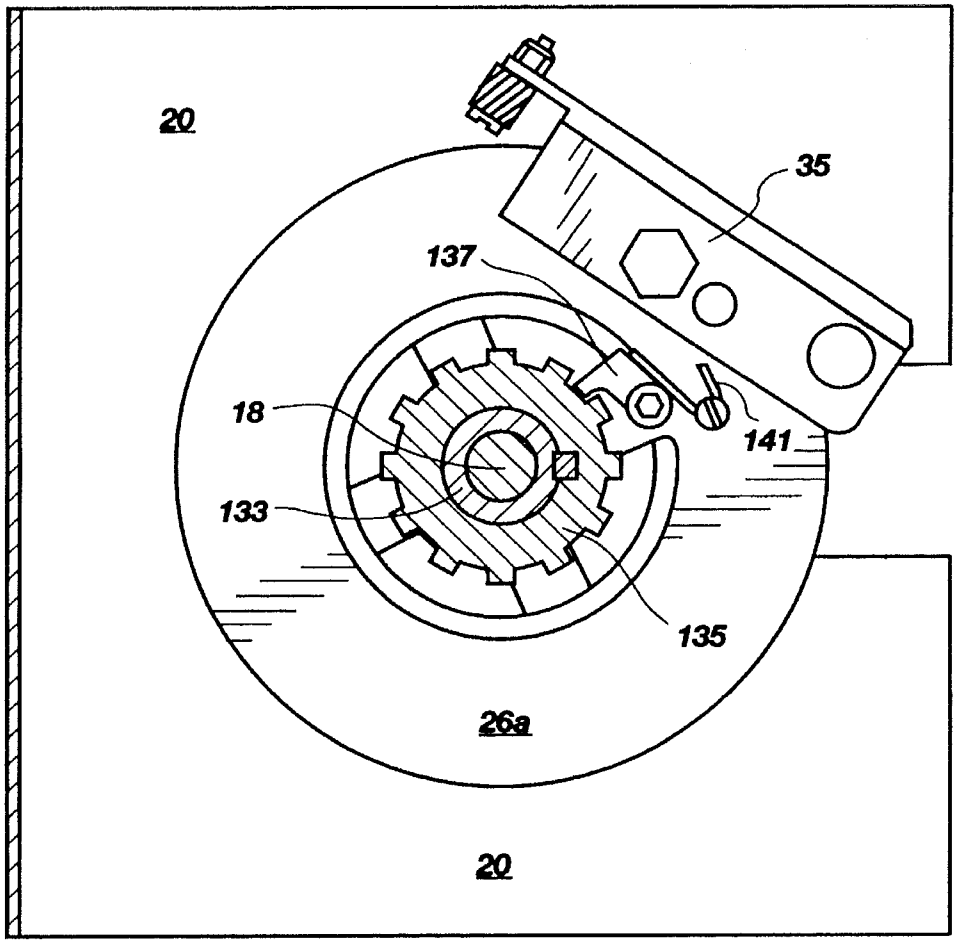
FIG. 18 is a cross-sectional view of the drive assembly of FIG. 16 taken along sectional lines 18—18.

FIGS. 16–18 illustrate a further embodiment of a drive assembly wherein the drive assembly 11 is fitted with two cable collecting reels 26*a* and 26*b*. As shown, each reel 26 is fitted with its own respective bush assembly 36 of the type described above with reference to FIG. 4. The two reels are rotatably mounted on a tubular cylindrical sleeve 133 which circumscribes the drive shaft 18. The end of the drive shaft 18 is fitted with a single dog 28. As shown to advantage in FIG. 17, the two reels 26*a* and 26*b* are mounted spacedly apart from one another on the sleeve 133. Positioned fixedly on the sleeve 133 by means of a key way union is a toothed rachet drive 135 (See FIG. 19). Each reel 26 is interconnected with the sleeve 133 by means of a rachet pawl 137 which engages through the rachet drum 135. Each pawl 137 is pivotedly mounted to its respective reel 26 by a bolt 139. A spring 141, attached to each reel 26 is biased against its respective pawl 137 and is adapted to bias the pawl against the drum 135. The details of this rachet assembly is described with more particularity in Applicant's prior U.S. Pat. No. 4,858,253 at Col. 5, line 29 through Col. 6, line 24, which description is hereby incorporated by reference.

Figure 21:
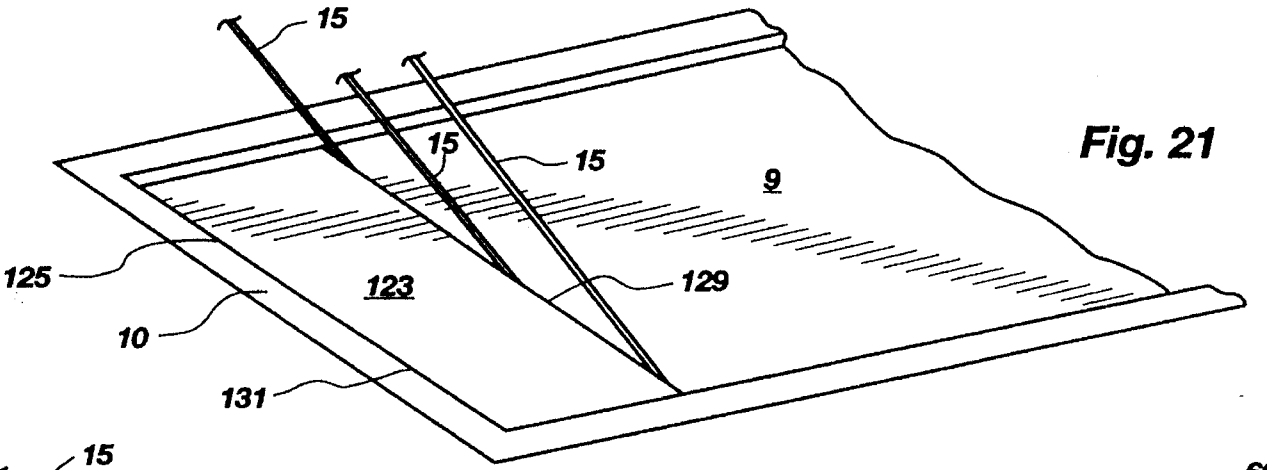
FIG. 21 is a perspective view of the cover of FIG. 19 in a closed condition.
Figure 20:
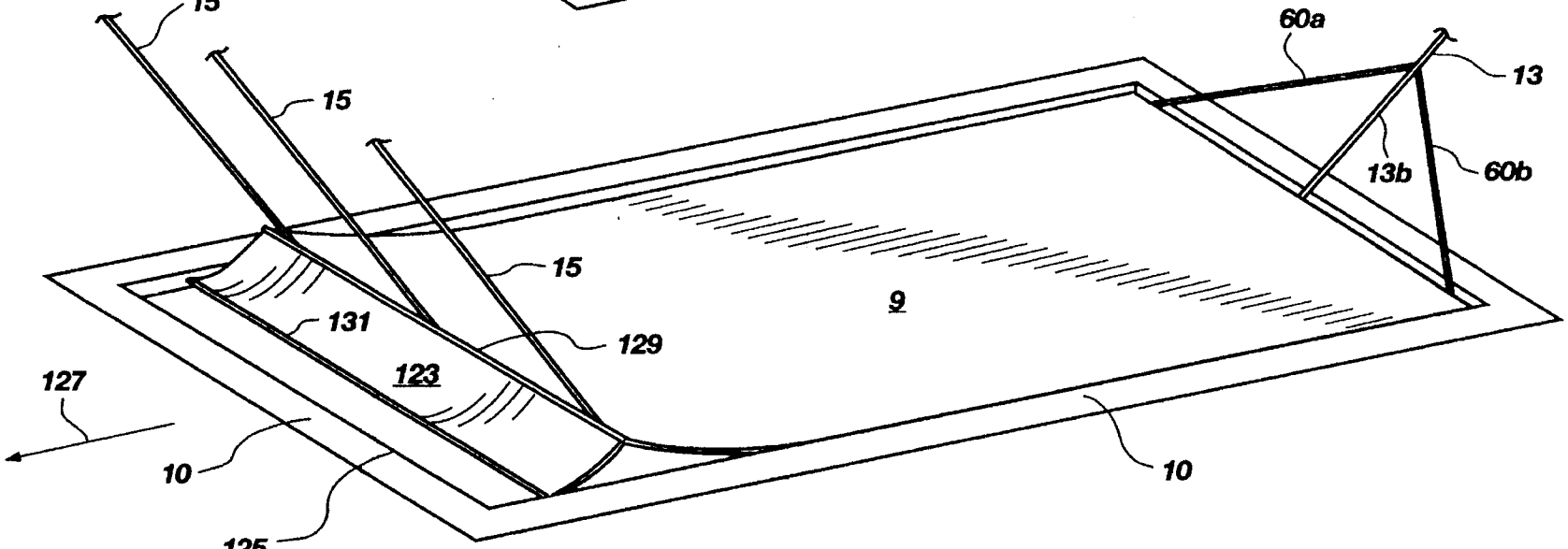
FIG. 20 is a view of the cover of FIG. 19 in its partially closed condition.
Figure 19:
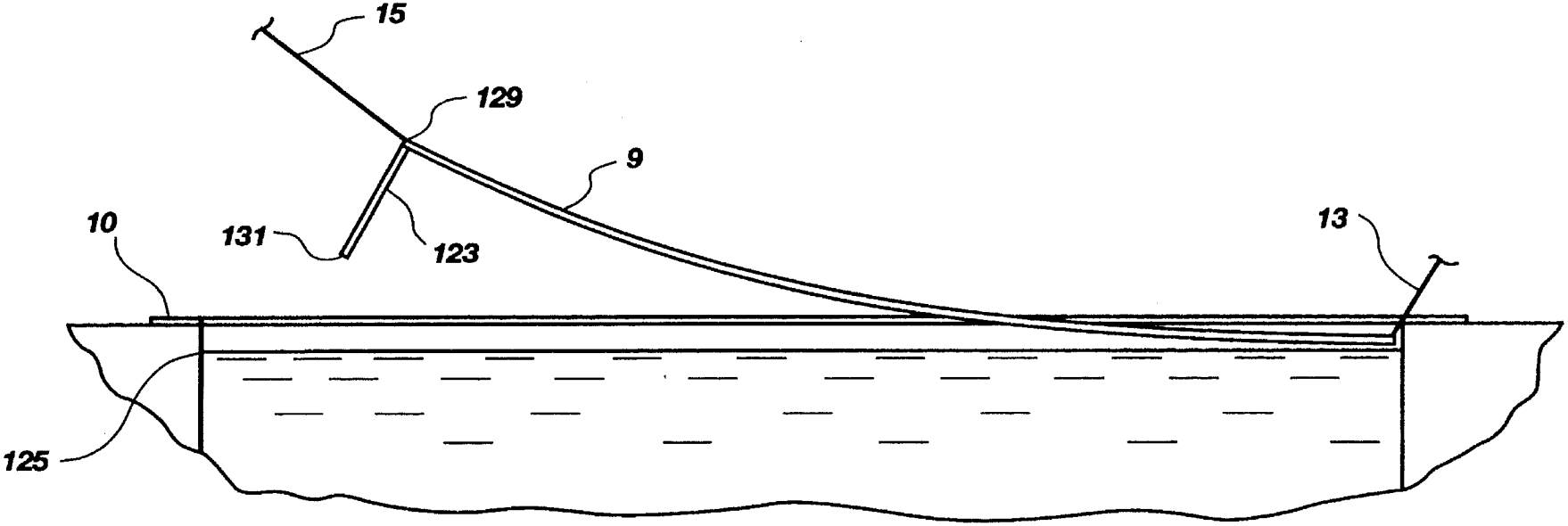
FIG. 19 is a perspective view of the cover of the invention.

FIGS. 19–21 illustrate the rear edge of the cover 9 fitted with a flap extension 123. As the cover 9 is lowered into place during its extension, it has been found that is difficult to completely cover the pool surface at the end of the pool proximate the drive assembly. The instant invention includes a flap-like cover extension which is secured to the cover 9 at the rear end of the cover and is adapted to be floated back into engagement against the rear end of the pool. Extension 123 is a rectangular panel, preferably fabricated from the same fabric as cover 9. The extension 123 is secured to cover 9 along end 129 thereof.

FIGS. 20 and 21 illustrate the operation of the flap 123. As shown in FIG. 20, as the cover 9 nears its complete installation, the flap 123 is directed toward the edge of the end of the pool 125 in the direction of arrow 127 so the straps 15 lower the cover 9 onto the surface of the water in the pool. As the straps 15 are lowered sufficiently to bring the end of the cover 129 into contact with the water, the flap 123 assumes a generally planar configuration, wherein the end 131 of the flap 123 is brought into engagement with the edge 125 thereby substantially forming a sealing cover over the pool water surface.

It is to be understood that the embodiments of the invention described are merely illustrative of the application of the principles of the invention. Reference herein to details of the illustrated embodiment is not intended to limit the scope of the claims which themselves recite those features regarded as essential to the invention.

What is claimed is:

1. An apparatus for extending and retracting a cover comprising;

a support;

a motor attached to said support;

a drive shaft connected to said motor;

a cable collecting reel mounted on said drive shaft to be free wheeling thereabout;

a cover collecting drum mounted on said drive shaft to be free wheeling thereabout;

a cover secured to said cover collecting drum;

a cable connected on its first end to said cable collecting reel and connected on its second end to a leading edge of said cover;

transmission means for drivingly engaging said cable collecting reel with said drive shaft in a first condition and for drivingly engaging said cover collecting drum with said drive shaft in a second condition to collect said cover on said cover collecting drum;

a sensor associated with said cover collecting drum for sensing a thickness of said cover collected on said cover collecting drum;

a brake associated with said cover collecting drum; and structure connecting said brake with said sensor for controlling the operation of said brake responsive to measurements of said thickness of said cover collected on said cover collecting drum as determined by said sensor.

2. The apparatus of claim 1 wherein said transmission means includes a first driven element mounted on said cover collecting drum and a second drive element is mounted on said cable collecting reel.

3. The apparatus of claim 2 wherein said transmission means further includes a driver element mounted on said drive shaft, said driver element being adapted to engage said first driven element in said first condition and said second driven element in said second condition.

4. The apparatus of claim 1 including a fabric cover connected to said cover collecting drum, said fabric cover having a leading edge.

5. The apparatus of claim 4 wherein said cover is fitted with a flap extension proximate its rear edge.

6. The apparatus of claim 4 wherein said leading edge is formed in a hem, and a elongate substantially rigid shaft is positioned within said hem to rigidify said leading edge.

7. The apparatus of claim 4 including a cable connected on its first end to said cable collecting reel, said cable being connected to said fabric cover leading edge on its second end.

8. The apparatus of claim 7 wherein said cable is suspended elevationally above said fabric cover.

9. The apparatus of claim 8 wherein said cable is initially directed from its securement on said cable collecting reel, parallel to said cover collecting drum and thereafter is directed elevationally above said fabric cover and parallel to said fabric cover's direction of travel and thereafter is directed downwardly to engage said leading edge of said fabric cover; said cable's orientation being controlled by a plurality of pulleys.

10. The apparatus of claim 7 wherein said cable is dimensioned such that upon retraction of said fabric cover from said swimming pool, said cable is completely unrolled from said cable collecting reel prior to said cover being completely collected on said cover collecting drum, wherein said cover collecting drum imparts tension to said cable sufficient to elongate said cable and elevate said cable above said swimming pool.

11. The apparatus of claim 7 further including at least one secondary cover collecting drum mounted on said drive shaft to be free wheeling thereabout and at least one secondary fabric cover connected to a respective said secondary cover collecting drum.

12. The apparatus of claim 11 wherein said fabric cover and said secondary covers are interconnected by means of an elongate shaft which extends through a hem formed in each of said fabric cover and said secondary covers.

13. The apparatus of claim 1 wherein said cable is positioned elevationally above said fabric cover.

14. The apparatus of claim 13 wherein a plurality of pulleys are associated with said cable to suspend said cable above said fabric cover over said swimming pool.

15. The apparatus of claim 1 wherein said cable includes a first nonstretchable segment and a second stretchable segment, said first segment being connected to said second segment.

16. The apparatus of claim 15 wherein said second segment of said cable forms said second end of said cable.

17. The apparatus of claim 1 wherein said shaft is filled with a weight means proximate its second end for urging said fabric cover into engagement with water in said swimming pool during said extension of said fabric cover over said swimming pool.

18. The apparatus of claim 1 wherein a cover collecting drum includes a brake means mounted thereon for applying a drag force on said cover collecting drum.

19. The apparatus of claim 18 wherein said brake means includes a control means for controlling the amount of drag force being applied to said cover collecting drum by said brake means.

20. The apparatus of claim 19 wherein said control means is adapted to adjust said drag force by reference to a diameter of the cover collected on said drum.

21. The apparatus of claim 1 further including a magnetic element associated with said cover; a sensing element, positioned atop a portion of said cover collected on said cover collecting drum, for sensing a passage of said magnetic element beneath said sensing element; and means for disengaging said transmission means from said second condition; said means being connected to said sensing element and being adapted to disengage said transmission means responsive to a measurement of said sensing element.

* * * * *